United States Patent [19]

Huntjens et al.

[11] Patent Number: 4,705,388

[45] Date of Patent: Nov. 10, 1987

[54] METHOD AND APPARATUS FOR DETERMINING WHEN A LAYER OF TACKY MATERIAL PRESENT ON A CLEANING MEMBER NEEDS TO BE REJUVENATED

[75] Inventors: Joseph M. J. E. Huntjens, Asten; Henricus G. J. M. Kockelmans, Tegelen; Jozef J. A. Pleyers, Baarlo, all of Netherlands

[73] Assignee: Oce-Nederland B.V., Venlo, Netherlands

[21] Appl. No.: 861,227

[22] Filed: May 8, 1986

[30] Foreign Application Priority Data

May 9, 1985 [NL] Netherlands ..... 8501321

[51] Int. Cl.[4] ..... G03G 21/00

[52] U.S. Cl. ..... 355/15; 118/60; 118/104; 118/691; 355/3 FU; 432/60; 432/75

[58] Field of Search ..... 355/3 R, 3 FU, 3 TR, 355/14 FU, 15; 432/60, 75; 101/425; 118/60, 104, 689, 691

[56] References Cited

U.S. PATENT DOCUMENTS

| | | | |
|---|---|---|---|
| 4,193,681 | 3/1980 | Tanigawa et al. | 355/3 FU |
| 4,272,182 | 6/1981 | Abe et al. | 355/14 D |
| 4,272,666 | 6/1981 | Collin | 355/3 FU X |
| 4,336,766 | 6/1982 | Maher et al. | 432/60 X |
| 4,607,947 | 8/1986 | Ensing et al. | 355/15 |

*Primary Examiner*—Fred L. Braun

*Attorney, Agent, or Firm*—Reed Smith Shaw & McClay

[57] ABSTRACT

A method and a device are provided for determining the moment that a layer of tacky material needs to be rejuvenated. Typically, the layer is present on a cleaning member for removing contaminants such as paper dust and softened toner material from a fusing surface. The method includes measuring the light reflection value of the layer of tacky material, comparing the measured light reflection value with a reference value and rejuvenating the layer of tacky material as soon as the measured light reflection value differs by a predetermined value from the reference value. The device implements the method of the present invention.

8 Claims, 2 Drawing Figures

METHOD AND APPARATUS FOR DETERMINING WHEN A LAYER OF TACKY MATERIAL PRESENT ON A CLEANING MEMBER NEEDS TO BE REJUVENATED

BACKGROUND OF THE INVENTION

1. Field of the Invention

The present invention relates to a method and device for determining when a layer of tacky material present on a cleaning member needs to be rejuvenated. Typically, the cleaning member removes contaminants such as paper dust and residual toner material from a fusing surface of a photocopying apparatus.

2. Description of the Prior Art

U.S. Pat. No. 4,013,400 describes a device for cleaning a fusing surface of a photocopier. The device has a cleaning member which is covered with a layer of tacky material for removing contaminants such as residual toner material and paper dust from the fusing surface. The device also has rejuvenators for applying a fresh layer of tacky material onto the cleaning member. The layer of tacky material present on the cleaning member is rejuvenated from time to time.

The amount of contaminants required to be removed from the fusing surface per copying cycle, however, may vary widely. Among other things, it is conditional on whether the kind of paper used gives off very little or a lot of paper dust. Periodic rejuvenation of the layer of tacky material has the disadvantage that the moment of rejuvenation will not occur when needed. If the moment of rejuvenation occurs too late, the fusing surface will be contaminated, resulting in deterioration of the copy quality. If the moment of rejuvenation occurs too early, the maximum permissible thickness of the tacky layer on the cleaning member will be reached too soon, thus, unnecessarily shortening the life of the cleaning member. Thus, there is a need to precisely determine the optimum moment for replenishment or rejuvenation of the tacky layer.

The problems associated with periodic rejuvenation are also present in other prior art devices. U.S. Pat. No. 4,000,963 describes a contact fuser asembly in a photocopier which contains a cleaning roll and a mechanism for applying a tacky material to the cleaning roll for rejuvenating the tacky surface of the cleaning roll. No method or apparatus is provided for determining when the tacky surface should be rejuvenated.

Other cleaning devices are known; however, they do not utilize a cleaning member with a tacky surface. For example, Japanese Patent Application No. 58-59484 describes an adhesive cleaning belt for removing toner from a photo receptor. A sensor detects when toner particles are present on the cleaning belt and, if present, moves a recovery roller into contact with the cleaning belt to remove the toner. There is no indication that the surface of the cleaning belt of the recovery roller is covered with a tacky material nor is any means provided for rejuvenating a layer of tacky material if it was present on either the cleaning belt or the recovery roller.

Similarly, U.S. Pat. No. 4,099,861 discloses a cleaning apparatus for removing particulate toner material from the photoconductive member of an electrophotographic copier using an air stream to entrain the toner particles. The toner particles are then removed from the air stream by a cyclone separator and a filter. It is very important that the entire cleaning apparatus be kept dry for the entrainment and subsequent removal of the toner particles. Additionally, a contamination sensor is provided to automatically shut down the copier when a malfunction occurs and excess toner particles are detected in the air stream downstream of the cyclone separator and filter.

SUMMARY OF THE INVENTION

Generally, the present invention relates to a method and a device for determining when a layer of tacky material present on a cleaning member needs to be rejuvenated or replenished wherein the light reflection of the layer of tacky material is measured and then compared with a reference value to determine whether rejuvenation is required.

The method according to the present invention is accomplished by a device for cleaning a surface that is in contact with a softened thermoplastic material such as toner material. The device comprises a cleaning member covered with a layer of tacky material for removing contaminants from the surface to be cleaned and a rejuvenator for applying a fresh layer of tacky material onto the cleaning member. The device is also provided with a means for measuring the light reflection of the layer of tacky material present on the cleaning member and a means for comparing the measured light reflection with a reference value which emits a signal to activate the rejuvenator when the difference between the measured value and the reference value is in a predetermined range. By determining the light reflection of the layer of tacky material and comparing it with a reference value, it is possible with the present invention to determine to a fair degree of accuracy the moment when the layer of tacky material needs to be rejuvenated or replenished. Thus, the aforementioned disadvantages of the known cleaning devices with periodic rejuvenation are avoided.

The light reflection of the layer of tacky material is preferably determined by means of a fixed number of measurements at different locations or areas on the surface of the layer of tacky material. These measurements are then used to determine a final light reflection value which is then compared with a reference value. Preferably, the final light reflection value determined from a previous series of measurements is used as a reference value. As soon as the difference between the final light reflection value and the reference value no longer exceeds a predetermined small value, this means that the cleaning action of the layer of tacky material is practically exhausted and that the tacky layer needs to be rejuvenated.

In another embodiment of the present invention, the light reflection of a fresh layer of tacky material is selected as a reference value. Whenever the final light reflection of the layer of tacky material differs from the reference value by more than a predetermined value, a fresh layer of tacky material will be applied to the cleaning member after which the light reflection of the freshly applied layer is used as reference value in the next measuring cycle.

Other features and advantages of the present invention will be apparent from the following detailed description and with reference to the accompanying drawings.

DESCRIPTION OF THE PREFERRED EMBODIMENT

Figure 1:
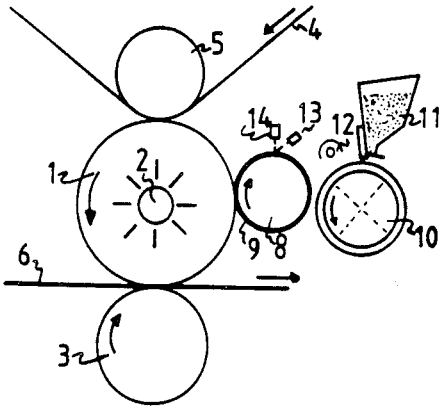
FIG. 1 is a diagrammatic cross-section of a transfer/-fusing device provided with a cleaning device utilizing the present invention.

The transfer/fusing device shown in FIG. 1 utilizes a fuser roll 1, rotatable in the direction indicated, which is coated with a layer of silicone rubber. Fuser roll 1 is heated by a heating element 2 which is disposed therein. A pressure roll 3, likewise coated with a layer of silicone rubber, bears against fuser roll 1. A photoconductive belt 4 is brought by a pressure roll 5 into pressure contact with fuser roll 1. This pressure contact causes an image consisting of toner powder which was formed in a conventional way on photoconductive belt 4 to be transferred onto fuser roll 1. The toner powder softens on the heated fuser roll 1. In the nip between fuser roll 1 and pressure roll 3, the softened material is transferred and simultaneously fused onto a sheet of receiving paper 6 which is supplied into this nip by a conveying means (not shown) and which may be heated during the conveyance to the nip.

A cleaning member consisting of a freely rotatable metal roll 8 having its surface coated with a layer of tacky material 9 bears against fuser roll 1 on the side where its surface moves towards photoconductive belt 4. Roll 8 is driven by fuser roll 1 and makes approximately 2.5 revolutions per second. By an internal heating means (not shown), roll 8 is heated up to a temperature exceeding the softening temperature of the material of which the tacky layer 9 consists.

In the vicinity of roll 8, a magnetic roll 10 coated with silicone rubber is disposed. Roll 10 can be covered with a layer of thermoplastic magnetically attractable powder from a powder reservoir 11 that can be opened and closed. Preferably, the powder has the same composition as the toner powder with which the powder images on photoconductive belt 4 are formed. Magnetic roll 10 can be brought from the position shown in FIG. 1 into a position in which it contacts roll 8 by a means which is not shown. The powder layer present on magnetic roll 10 is softened by a heating element 12 before being transferred onto roll 8. A light-emitting diode 13 and a phototransistor 14 are fitted above roll 8.

Figure 2:
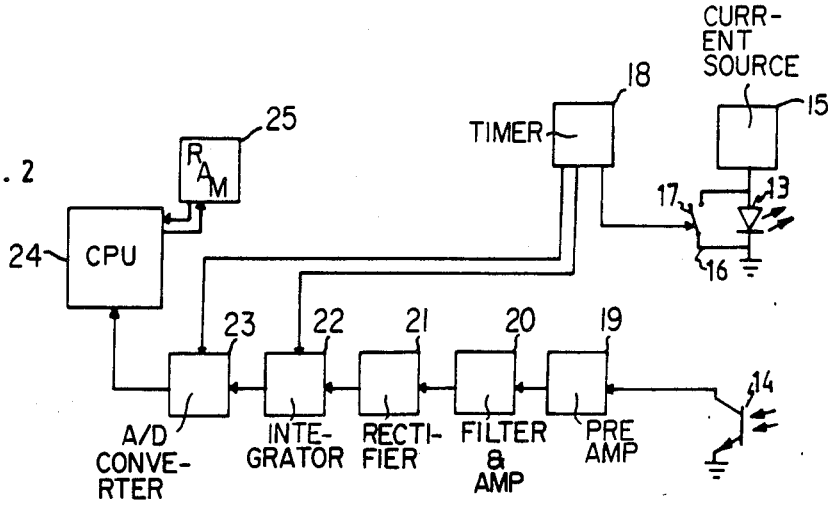
FIG. 2 is a block diagram of the circuit used in the present invention for measuring and comparing the light reflection value with a reference value.

The electrical circuit used in the present invention will now be explained with reference to FIG. 2. Light-emitting diode 13 is connected to a current source 15 supplying a constant and relatively high d.c. current to obtain a high light output from diode 13 which is necessary to obtain a measurable light reflection from a layer 9 of black tacky material. Electronic switch 17 is connected to current source 15 in parallel with light-emitting diode 13.

When switch 17 is closed, diode 13 does not emit light. However, when switch 17 is open, diode 13 emits light. Switch 17 is controlled by a timing circuit 18 in such a way that it is alternately opened and closed at a frequency of 10 KHZ. This permits approximately 10 measurements a second to be made. Typically, switch 17 is kept closed for a longer period of time than it is kept open. For example, at 10 KHZ, switch 17 is kept open for only 13 msec. and then is kept closed for 90 msec. This prevents diode 13 from being overcharged. Because roll 8 is moving, the measurements are made at different locations or areas of the surface of tacky layer 9.

The light emitted by diode 13 is partially and diffusely reflected by the surface of tacky layer 9. The degree of reflection depends on the amount of paper dust absorbed by tacky layer 9. Part of the light reflected by tacky layer 9 is caught by phototransistor 14. The output signal from phototransistor 14 is supplied to a rectifier 21, via a preamplifier 19 and a 10 KHZ bandpass filter and amplifier 20. The output signal from rectifier 21 is supplied to an integrator 22 whose integration time is controlled by a timing circuit 18. At the end of every integration period, the output signal of integrator 22 is supplied to an anolog to digital converter (ADC) 23.

The output signal from ADC 23 is supplied to a central processing unit (CPU) 24. CPU 24 adds the measure values of a plurality of successive measurements, such as 100 measurements, to obtain a final value. The final value could be obtained in other ways such as by averaging the measure values. Subsequently, the CPU compares the final value with the reference value stored in a random access memory (RAM) 25 and determines the difference. Preferably, the reference value is the final value of a previous series of measurements consisting of the same number of measurements. The difference between the final value of the last series of measurements and the reference value is then compared with a fixed value likewise being stored in RAM 25. If the difference is smaller than or equal to the fixed value, this indicates that the tacky layer is absorbing very little paper dust and needs to be rejuvenated.

Subsequently, CPU 24 will generate a signal which will activate the rejuvenator. Typically, the rejuvenator comprises roll 10, powder reservoir 11 and heating element 12 to apply a fresh layer of tacky material onto roll 8. The measuring device is switched off during rejuvenation of tacky layer 9.

If the difference between the final value and the reference value is greater than the fixed value, the tacky layer still absorbs sufficient paper dust, and rejuvenation of the tacky layer is not yet necessary. After comparing the final value of a series of succesive measurements with the reference value, the final value resulting from the last series of measurements is stored each time in RAM 25 to serve as the new reference value for the following series of measurements.

The fixed value stored in RAM 25, with which the difference between the reference value and the final value of a series of measurements is compared, is determined experimentally by recording under operating conditions the difference between the final values of successive series of measurements, each consisting of 100 measurements, for example, and determining by observation the moment at which the cleaning effect of tacky layer 9 on roll 8 has become insufficient. Since the fixed value has been stored in a RAM, it can be changed, if necessary, via the operating panel of the copying apparatus. This would be necessary if a switch was made to a tacky material of another composition.

In another embodiment of the invention, the reflection of a fresh layer of tacky material, as determined by a first series of measurements, is selected as the reference value. Then, the average value of each series of measurements (again, a series of 100 measurements, for example) is compared with the reference value, and as soon as the difference between the two values exceeds an experimentally predetermined value, CPU 24 will generate a signal which activates the rejuvenator. After a fresh layer of tacky material is applied to roll 8, the average value of the first series of measurements from the fresh layer of tacky material is stored in RAM 25 as the new reference value to replace the previous reference value.

If a device utilizing the present invention is used in an electrophotographic copying apparatus, rejuvenation of tacky layer 9 can also be effected by electrostatically charging one or more successive sections of photoconductive belt 4 followed by development with toner powder. The toner layer on photoconductive belt 4 is then conveyed through the transfer/fusing device while pressure roll 3 is withdrawn from the fusing roll 1 and no sheet of receiving paper is supplied. Thus, the toner layer is transferred onto the surface of roll 8 thereby rejuvenating it.

While presently preferred embodiments of the invention have been described and shown in the drawings with particularity, the invention may be otherwise embodied within the scope of the appended claims. Accordingly, numerous modifications may be made within the scope of the appended claims, particularly with respect to the light-emitting and light-detecting elements and the associated electrical circuit.

What is claimed is:

1. A method for determining when a layer of tacky material present on a cleaning member for removing contaminants needs to be rejuvenated comprising the steps of:

(a) repeatedly measuring light reflected by the layer of tacky material;

(b) generating a final value from the measured values;

(c) comparing the final value with a reference value to determine whether the layer of tacky material requires rejuvenation.

2. A method according to claim 1 wherein the step of repeatedly measuring the light reflected by the layer of tacky material comprises measuring the light reflected a fixed number of times so that the measurements occur at different areas of the surface of the layer of tacky material.

3. A method according to claim 2 further comprising using the final value from a fresh layer of tacky material as a reference value and activating the rejuvenator if the difference between the final value and the reference value is equal to or greater than a predetermined fixed value.

4. A method according to claim 2 further comprising using the final value from a previous determination as a reference value in the next determination and activating the rejuvenator if the difference between the final value and the reference value is smaller than or equal to a predetermined fixed value.

5. A method according to claim 1 further comprising using the final value from a fresh layer of tacky material as a reference value and activating the rejuvenator if the difference between the final value and the reference value is equal to or greater than a predetermined fixed value.

6. A method according to claim 1 further comprising using the final value from a previous determination as a reference value in the next determination and activating the rejuvenator if the difference between the final value and the reference value is smaller than or equal to a predetermined fixed value.

7. A device for cleaning a surface that has been put into contact with a softened thermoplastic material, comprising:

(a) a cleaning member contacting the surface to be cleaned and being covered with a layer of tacky material for removing contaminants from the surface to be cleaned;

(b) a rejuvenator for applying a fresh layer of tacky material onto the cleaning member;

(c) a means for repeatedly measuring light reflected by the layer of tacky material present on the cleaning member;

(d) a means for comparing the measured light reflection with a reference value and emitting a signal as soon as the difference between the measured value and the reference value is in a predetermined range to activate the rejuvenator.

8. A device according to claim 7 wherein the means for measuring the light reflected by the layer of tacky material comprises a light source connected to a current source and a switching means to interrupt the current to the light source between two successive measurements.

* * * * *